US011293699B2

(12) United States Patent
Li et al.

(10) Patent No.: US 11,293,699 B2
(45) Date of Patent: Apr. 5, 2022

(54) AUTOMATIC SECONDARY DEGASSING FIXED-LENGTH MECHANISM FOR ULTRATHIN HEAT PIPE

(71) Applicants: SOUTH CHINA UNIVERSITY OF TECHNOLOGY, Guangdong (CN); GUANGDONG NEWIDEA TECHNOLOGY CO., LTD., Guangdong (CN)

(72) Inventors: Yong Li, Guangzhou (CN); Wenjie Zhou, Guangzhou (CN); Bailin He, Guangzhou (CN); Guangwen Huang, Guangzhou (CN); Chuangxin Chen, Guangzhou (CN); Hanyin Chen, Guangzhou (CN)

(73) Assignees: South China University of Technology, Guangzhou (CN); Guangdong Newidea Technology Co., Ltd., Guangzhou (CN)

( * ) Notice: Subject to any disclaimer, the term of this patent is extended or adjusted under 35 U.S.C. 154(b) by 750 days.

(21) Appl. No.: 16/318,445

(22) PCT Filed: Nov. 14, 2017

(86) PCT No.: PCT/CN2017/110900
§ 371 (c)(1),
(2) Date: Jan. 17, 2019

(87) PCT Pub. No.: WO2018/157621
PCT Pub. Date: Sep. 7, 2018

(65) Prior Publication Data

US 2019/0293357 A1 Sep. 26, 2019

(30) Foreign Application Priority Data

Mar. 1, 2017 (CN) ..... 201710115982.2

(51) Int. Cl.
*F28D 15/02* (2006.01)

(52) U.S. Cl.
CPC ..... *F28D 15/0258* (2013.01); *F28D 15/02* (2013.01); *F28D 15/0283* (2013.01); *Y10T 29/49353* (2015.01)

(58) Field of Classification Search
CPC .. F28D 15/0258; F28D 15/02; F28D 15/0283; F28D 15/046; Y10T 29/49353
(Continued)

(56) References Cited

U.S. PATENT DOCUMENTS 7,404,255 B2 * 7/2008 Li ..... B01D 5/0093 165/104.18
7,430,803 B2 * 10/2008 Li ..... F25B 23/006 165/104.18

(Continued)

FOREIGN PATENT DOCUMENTS

CN 202692783 U 1/2013
CN 104551697 A 4/2015
CN 101532793 A 9/2016
CN 106931813 A 7/2017
CN 206695656 U 12/2017

*Primary Examiner* — Jon T. Schermerhorn, Jr.
(74) *Attorney, Agent, or Firm* — The Dobrusin Law Firm, PC

(57) ABSTRACT

Provided is an automatic secondary degassing fixed-length mechanism for an ultrathin heat pipe. The automatic secondary degassing fixed-length mechanism comprises an automatic lifting device A installed on a length adjustment sliding table, an automatic clamping device B, a length positioning and extension device C and a PLC. The present invention, having the advantages of simple structure, high efficiency and stability, is suitable for the secondary degassing fixed-length processing of heat pipes of different lengths, and particularly suitable for processing ultrathin heat pipes made of a thin-walled heat pipe by a flattening process, having advanced structural design and stable and high-efficiency production. In this mechanism, size position- (Continued)

ing and automatic clamping in the secondary degassing fixed-length process for the heat pipes are correspondingly achieved through the automatic lifting device A and the automatic clamping device B. Downward component force applied to the thin-walled heat pipes in the die-opening-sealing process is released through the length positioning and extension device C, so that deformation of bending or partial sinking of pipe bodies of the thin-walled heat pipes in the secondary degassing fixed-length process is avoided. In this way, the qualification rate of the products and the economic benefit of the enterprise are greatly improved, and the problems with the existing secondary degassing fixed-length processing of the ultrathin heat pipe are solved.

6 Claims, 6 Drawing Sheets

(58) Field of Classification Search
USPC ..... 414/785
See application file for complete search history.

(56) References Cited

U.S. PATENT DOCUMENTS

2004/0194311 A1* 10/2004 Hsu ..... F28D 15/0258 29/890.032
2006/0117557 A1* 6/2006 Li ..... F28D 15/0283 29/726
2006/0144230 A1* 7/2006 Li ..... B01D 5/0093 95/241
2006/0150647 A1* 7/2006 Li ..... F25B 43/04 62/197
2006/0162160 A1* 7/2006 Hsu ..... F28D 15/0258 29/890.032
2007/0074395 A1* 4/2007 Hou ..... H01L 21/4882 29/890.032
2007/0074396 A1* 4/2007 Hou ..... F28D 15/0283 29/890.032
2013/0126128 A1* 5/2013 Chou ..... F28D 15/04 165/104.21

* cited by examiner

AUTOMATIC SECONDARY DEGASSING FIXED-LENGTH MECHANISM FOR ULTRATHIN HEAT PIPE

FIELD OF THE INVENTION

The present invention belongs to the field of mechanical manufacturing technology, and relates to a processing device for mobile phone heat pipes, in particular to an automatic secondary degassing fixed-length mechanism for an ultrathin heat pipe.

BACKGROUND OF THE INVENTION

With the rapid development of Internet technology and electronic technology, the performance of smart phones is becoming increasingly strong. However, the problem of heat dissipation from mobile phones brought about by operation is becoming more and more prominent. The ultrathin heat pipe for heat dissipation has high thermal conductivity (up to dozens to hundreds of times of ordinary metal), good temperature uniformity, high reliability, and no need for additional energy drive, so the application of the ultrathin heat pipe to the heat dissipation of smart phones can effectively solve the heat dissipation problems of overheating and local "hot spots" with smart phones.

The ultrathin heat pipe (having an overall thickness of 0.30-0.60 mm) used in smart phones is made of a thin-walled heat pipe by a flattening process. The wall of the thin-walled heat pipe is very thin, having a thickness of only 0.05-0.15 mm. However, the thin-walled heat pipe will be subjected to many processing steps and is prone to deformation or sinking during processing, especially in the secondary degassing process of the ultrathin heat pipe, where the pipe body is in an annealed soft state and has greatly reduced mechanical strength and is thus more prone to deformation or sinking. In the secondary degassing process, with the heat pipe installed vertically, the heat pipe is clamped at the bottom by a clamp and heated, the top of the heat pipe is sealed by a die and cut off, and the non-condensable gas inside the heat pipe is removed based on the boiling exhaust principle, thereby further improving the internal vacuum degree of the heat pipe. Chinese Patent Application No. 201110446349.4 disclosed "Secondary Degassing Fixed-Length Mechanism for Ultrathin Heat Pipe", and Chinese Patent Application Nos. 201410856094.2 and 201210177860.3 respectively disclosed "Fully Automatic Heat Pipe Degassing Sealing Device" and "Heat Pipe Degassing Fixed-Length Sealing Processing Device". In these devices, the bottom of the heat pipe was rigidly supported, and the thin-walled heat pipe was not suitable for processing because it was subjected to a downward component force (in the position A as shown in FIG. 1) in the die-opening-sealing process; under the action of the downward component force, the body of the thin-walled heat pipe would be deformed by being bent, and sinking would occur in the position B as shown in FIG. 1. With the prior art, no obvious partial sinking occurs during the secondary degassing process of a conventional heat pipe, because the conventional heat pipe has a wall thickness of 0.20 mm or more and is high in strength. When a thin-walled heat pipe with a wall thickness of 0.05-0.15 mm is used to make an ultrathin heat pipe, the pipe body of the thin-walled heat pipe is prone to partial sinking during the secondary degassing process, and is also easily flattened by a clamping mechanism, resulting in a greatly increased defective product rate.

Contents of the Invention

In view of the above problems, the object of the present invention is to provide an automatic secondary degassing fixed-length mechanism for an ultrathin heat pipe with simple structure, high efficiency and stability; this mechanism automatically clamps the thin-walled heat pipes of different lengths by an automatic lifting device, an automatic clamping device and a length positioning and extension device, and then performs secondary degassing after releasing the deformation caused by the downward component force, thereby solving the above problems in the existing ultrathin heat pipe processing.

A technical solution of the present invention is as follows: An automatic secondary degassing fixed-length mechanism for an ultrathin heat pipe is provided, characterized in the following aspects: the mechanism comprises an automatic lifting device A installed on a length adjustment sliding table, an automatic clamping device B, a length positioning and extension device C and a PLC;

the automatic lifting device A is composed of a lifting cylinder base, a lifting cylinder, a lifting cylinder connecting plate, a support plate, and a reference bottom plate; the lifting cylinder is locked on the lifting cylinder base installed on the length adjustment sliding table, the two support plates are vertically and fixedly mounted on a piston push plate of the lifting cylinder via the lifting cylinder connecting plate, and the reference bottom plate is fixedly mounted above the two vertically mounted support plates;

the automatic clamping device B is composed of a bakelite base mounting plate, a bakelite base, a heating block, a clamping cylinder fixing plate, a clamping cylinder mounting plate, a clamping cylinder, a linear guide pair, a clamping push plate, a clamping block, a linear guide mounting plate, and a heating block mounting seat; the plurality of the uniformly arranged bakelite base mounting plates, and the two clamping cylinder fixing plates and the two linear guide mounting plates symmetrically disposed are locked on the reference bottom plate, and the heating block is inserted into the respective bakelite bases fixed on the bakelite base mounting plates through the heating block mounting seat; the two clamping cylinders are connected to the clamping cylinder fixing plate via the vertically mounted clamping cylinder mounting plate, and the linear guide pair fixed on the two linear guide mounting plates and consisting of a slider and a guide rail is fixed to the clamping push plate provided in the front end with the clamping block; and the length positioning and extension device C is composed of a floating joint bottom plate, a floating bottom plate, an extension cylinder, a cylinder floating joint, and a fixed-length shaft; the extension cylinder is fixed on the surface of the reference bottom plate; the floating bottom plate on the floating joint bottom plate is connected by the cylinder floating joint; and the floating bottom plate is provided with the fixed-length shaft corresponding to the respective automatic clamping device B.

The automatic secondary degassing fixed-length mechanism for the ultrathin heat pipe of the present invention is also characterized in the following aspects:

a heating rod is inserted in two vertical bare holes provided in the heating block mounting seat inserted in the bakelite base of the automatic clamping device B;

the mounting hole, via which the reference bottom plate and the bakelite base are fixed to the bakelite base mounting plate, is a waist-shaped stepped hole;

the heating block is provided at its gripping portion with a recess for holding a thin-walled heat pipe;

the clamping block of the automatic clamping device B is provided at its clamping end with a clamping jacket made of a soft, high temperature resistant material; and the floating bottom plate connected to the extension cylinder of the length positioning and extension device C is provided with two sets of guide shafts, which are slidably connected to the reference bottom plate via an oil-free bushing mounted on the reference bottom plate and guide downward movement of the cylinder floating joint.

The automatic secondary degassing fixed-length mechanism for the ultrathin heat pipe of the present invention is suitable for the secondary degassing fixed-length processing of heat pipes of different lengths, and particularly suitable for processing ultrathin heat pipes made of a thin-walled heat pipe (having a wall thickness of 0.05-0.15 mm) by a flattening process, having advanced structural design and stable and high-efficiency production. In this mechanism, size positioning and automatic clamping in the secondary degassing fixed-length process for the thin-walled heat pipes are correspondingly achieved through the automatic lifting device A and the automatic clamping device B. Downward component force generated in the die-opening-sealing process is released through the length positioning and extension device C, so that deformation of bending or partial sinking of pipe bodies of the thin-walled heat pipes in the secondary degassing fixed-length process is avoided, greatly improving the qualification rate of the products and the economic benefits of the enterprise.

BRIEF DESCRIPTION OF THE DRAWINGS

FIGS. 5 and 6 are schematic structural views of the length positioning and extension device according to the present invention;

In the figures: 1. a lifting cylinder base; 2. a lifting cylinder; 3. a lifting cylinder connecting plate; 4. a support plate; 5. a reference bottom plate; 6. a bakelite base mounting plate; 7. a bakelite base; 8. a heating block; 9. a thin-walled heat pipe; 10. a floating joint bottom plate; 11. a floating bottom plate; 12. a clamping cylinder fixing plate; 13. a clamping cylinder mounting plate; 14. a clamping cylinder; 15. an extension cylinder; 16. a linear guide pair; 17. a clamping push plate; 18. a clamping block; 19. a clamping jacket; 20. a cylinder floating joint; 21. a fixed-length shaft; 22. a linear guide mounting plate; 23. a heating block mounting seat; 24. an oil-free bushing; 25. a guide shaft; and 26. a heating rod;

DETAILED DESCRIPTION OF THE EMBODIMENTS

The present invention will be described below in detail with reference to drawings and specific embodiments.

Figure 1:
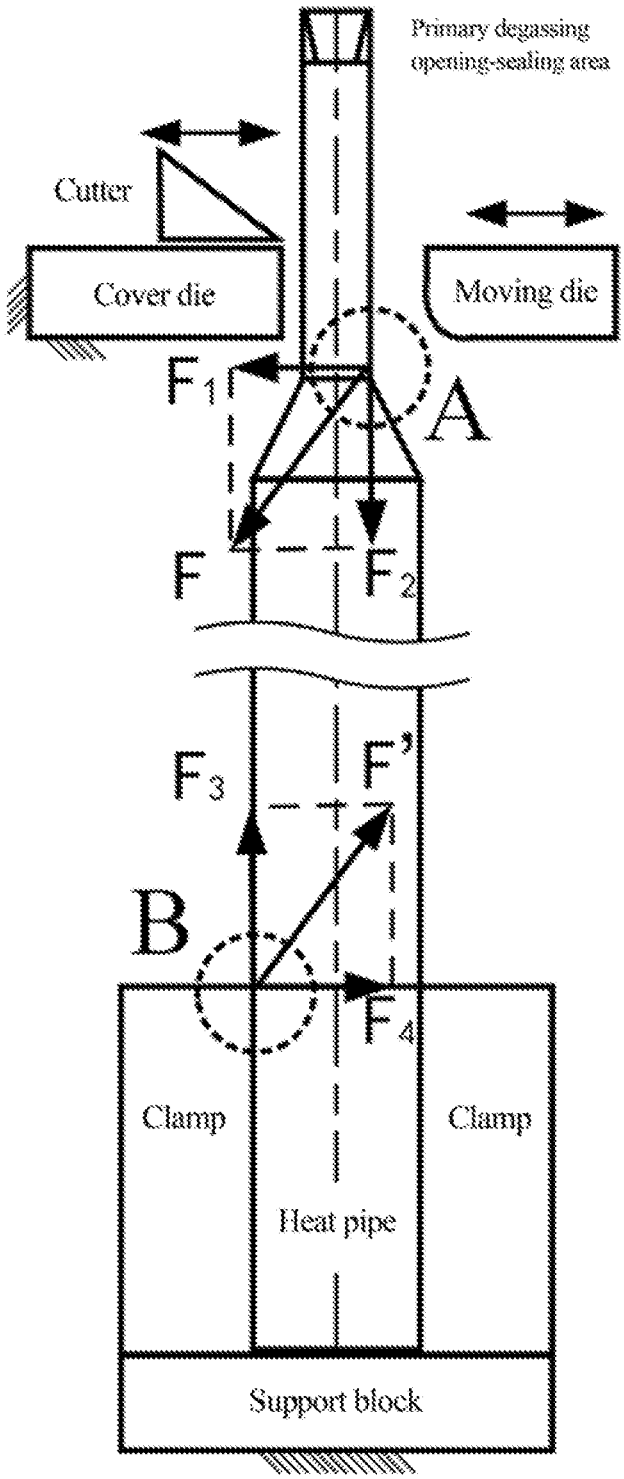
FIG. 1 is a schematic view showing the force analysis of the fixed-length processing of an existing secondary degassing fixed-length mechanism for the ultrathin heat pipe.
Figure 2:
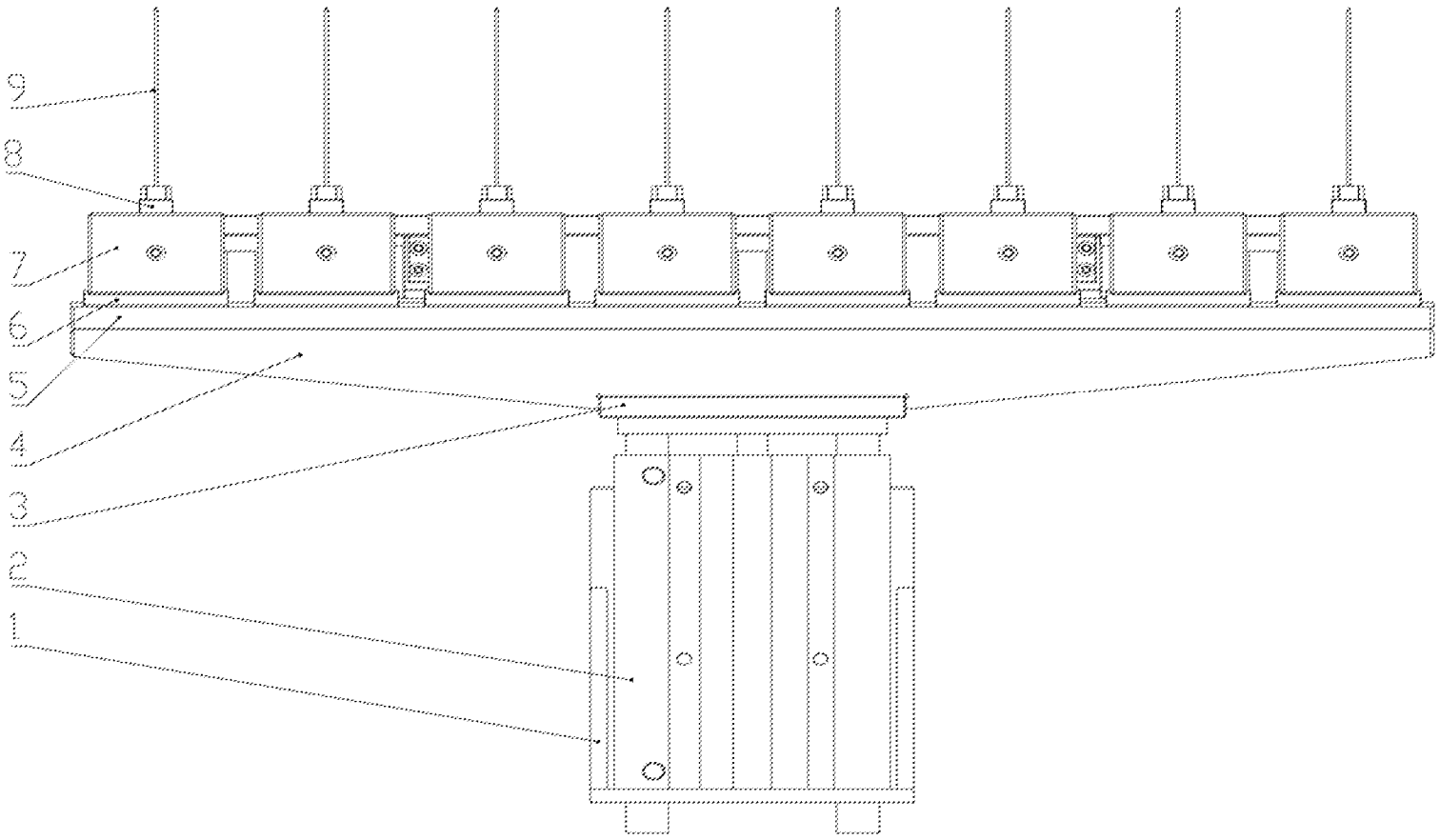
FIGS. 2 and 3 are schematic structural views of the secondary degassing fixed-length mechanism for the ultrathin heat pipe according to the present invention.
Figure 3:
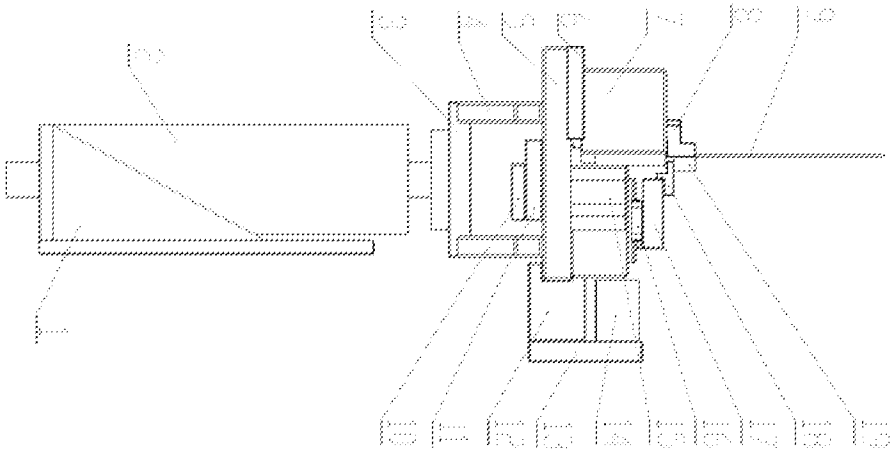

Provided is an automatic secondary degassing fixed-length mechanism for an ultrathin heat pipe, as shown in FIGS. 2 and 3. This mechanism comprises an automatic lifting device A installed on a length adjustment sliding table, an automatic clamping device B, a length positioning and extension device C and a PLC; the automatic lifting device A is composed of a lifting cylinder base 1, a lifting cylinder 2, a lifting cylinder connecting plate 3, a support plate 4, and a reference bottom plate 5; the lifting cylinder 2 is locked on the lifting cylinder base 1 installed on the length adjustment sliding table, the two support plates 4 are vertically and fixedly mounted on a piston push plate of the lifting cylinder 2 via the lifting cylinder connecting plate 3, and the reference bottom plate 5 is fixedly mounted above the two vertically mounted support plates 4.

Figure 4:
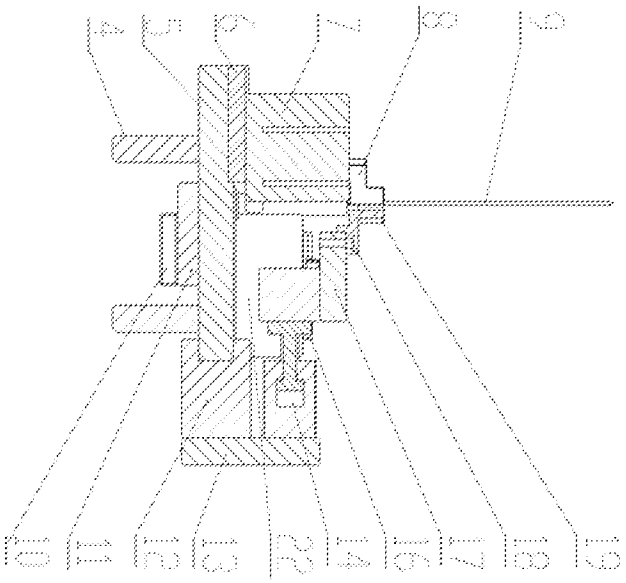
FIGS. 4 and 5 are schematic structural views of the automatic clamping device according to the present invention.
Figure 5:
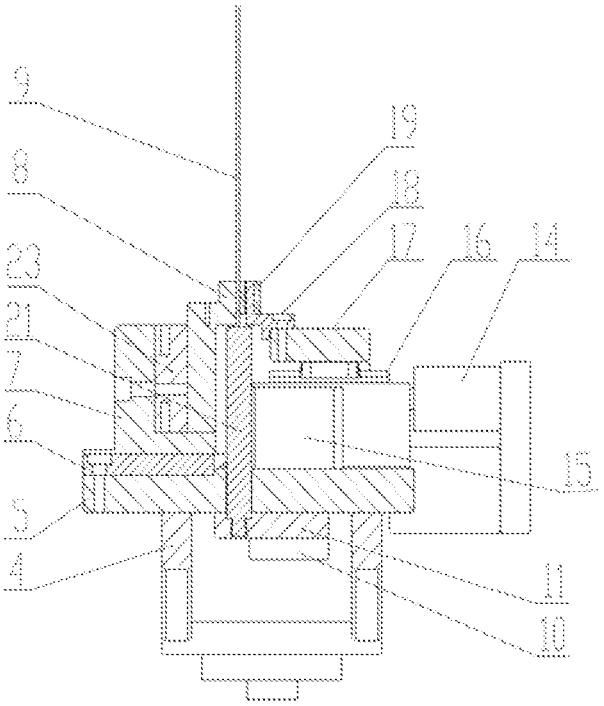

The automatic clamping device B of the present invention, as shown in FIGS. 4 and 5, is composed of a bakelite base mounting plate 6, a bakelite base 7, a heating block 8, a clamping cylinder fixing plate 12, a clamping cylinder mounting plate 13, a clamping cylinder 14, a linear guide pair 16, a clamping push plate 17, a clamping block 18, a linear guide mounting plate 22, and a heating block mounting seat 23; the plurality of the uniformly arranged bakelite base mounting plates 6, and the two clamping cylinder fixing plates 12 and the two linear guide mounting plates 22 symmetrically disposed are locked on the reference bottom plate 5, and the heating block 8 is inserted into the respective bakelite bases 7 fixed on the bakelite base mounting plates 6 through the heating block mounting seat 23; the two clamping cylinders 14 are connected to the clamping cylinder fixing plate 12 via the vertically mounted clamping cylinder mounting plate 13, and the linear guide pair 16 fixed on the two linear guide mounting plates 22 and consisting of a slider and a guide rail is fixed to the clamping push plate 17 provided in the front end with the clamping block 18, the clamping block 18 being provided at its clamping end with a clamping jacket 19 made of a soft, high temperature resistant material.

Figure 7:
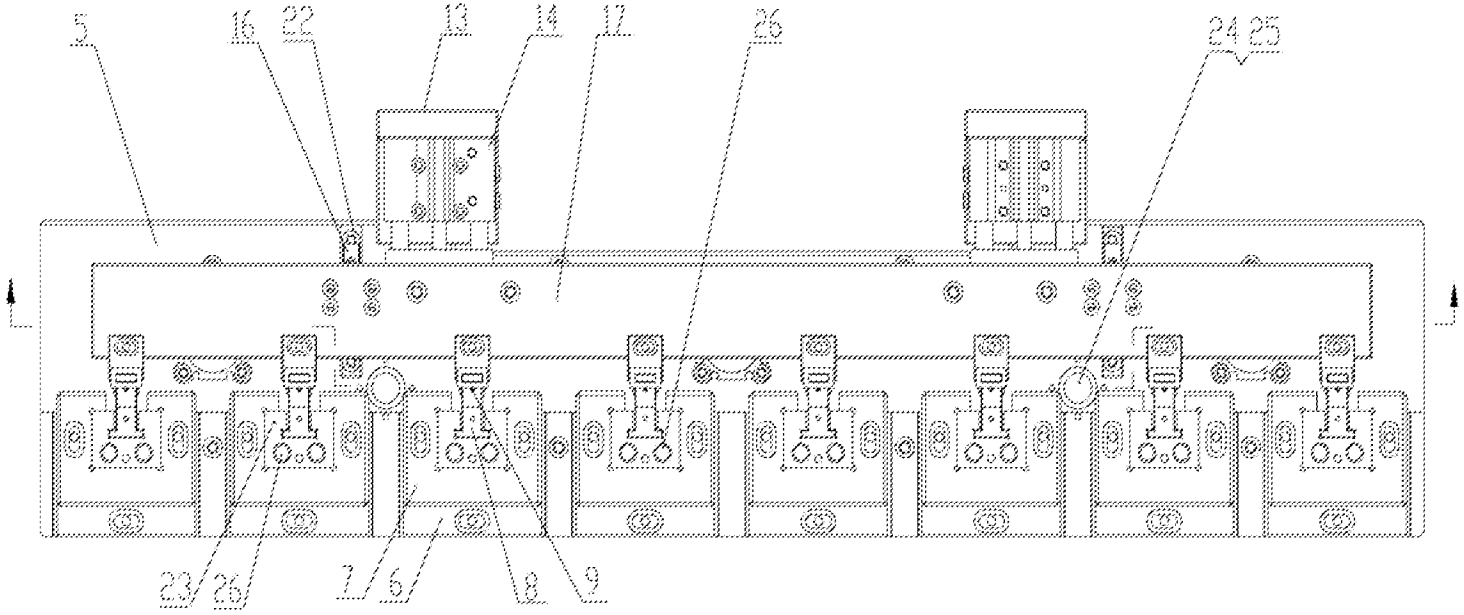
FIG. 7 is a schematic structural top view of the secondary degassing fixed-length mechanism for the ultrathin heat pipe according to the present invention.

The mounting hole, via which the reference bottom plate 5 is fixed to the bakelite base mounting plate 6 of the automatic clamping device B of the present invention, is a waist-shaped stepped hole, as shown in FIG. 7; the bakelite base mounting plate 6 can be slid left and right along the waist-shaped hole of the reference bottom plate 5 to adjust the automatic clamping device B in the left and right direction. The mounting hole, via which the bakelite base 7 is fixed to the bakelite base mounting plate 6, is also a waist-shaped stepped hole; the bakelite base 7 can be slid back and forth along the waist-shaped hole of the bakelite base mounting plate 6 to adjust the automatic clamping device B in the back and forth direction, so that the thin-walled heat pipe can smoothly enter a guide hole of a female die in the opening-sealing area.

Figure 6:
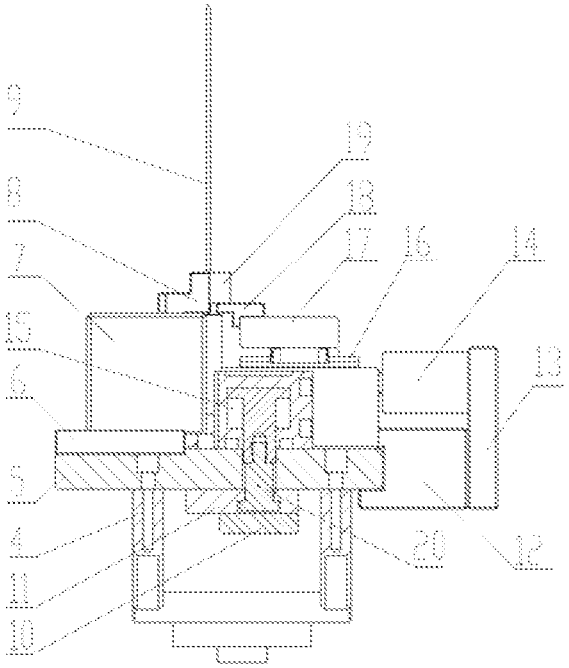

The length positioning and extension device C of the present invention, as shown in FIGS. 5 and 6, is composed of a floating joint bottom plate 10, a floating bottom plate 11, an extension cylinder 15, a cylinder floating joint 20, and a fixed-length shaft 21; the extension cylinder 15 is fixed on the surface of the reference bottom plate 5; the floating bottom plate 11 on the floating joint bottom plate 10 is connected by the cylinder floating joint 20; and the floating bottom plate 11 is provided with the fixed-length shaft 21 corresponding to the respective automatic clamping device B. The lower end of the fixed-length shaft 21 is machined to have an external thread, by which the fixed-length shaft 21 is vertically locked on the floating bottom plate 11; the upper end of the fixed-length shaft 21 has a flat surface, which is a positioning surface of the bottom of the heat pipe when the heat pipe is vertically inserted into the gap between the heating block 8 and the clamping jacket 19. After the clamping is completed, the extension cylinder 15 lifts the floating bottom plate 11 up and down by extending and retracting its piston rod, thereby driving the fixed-length shaft 21 to move up and down.

Figure 8:
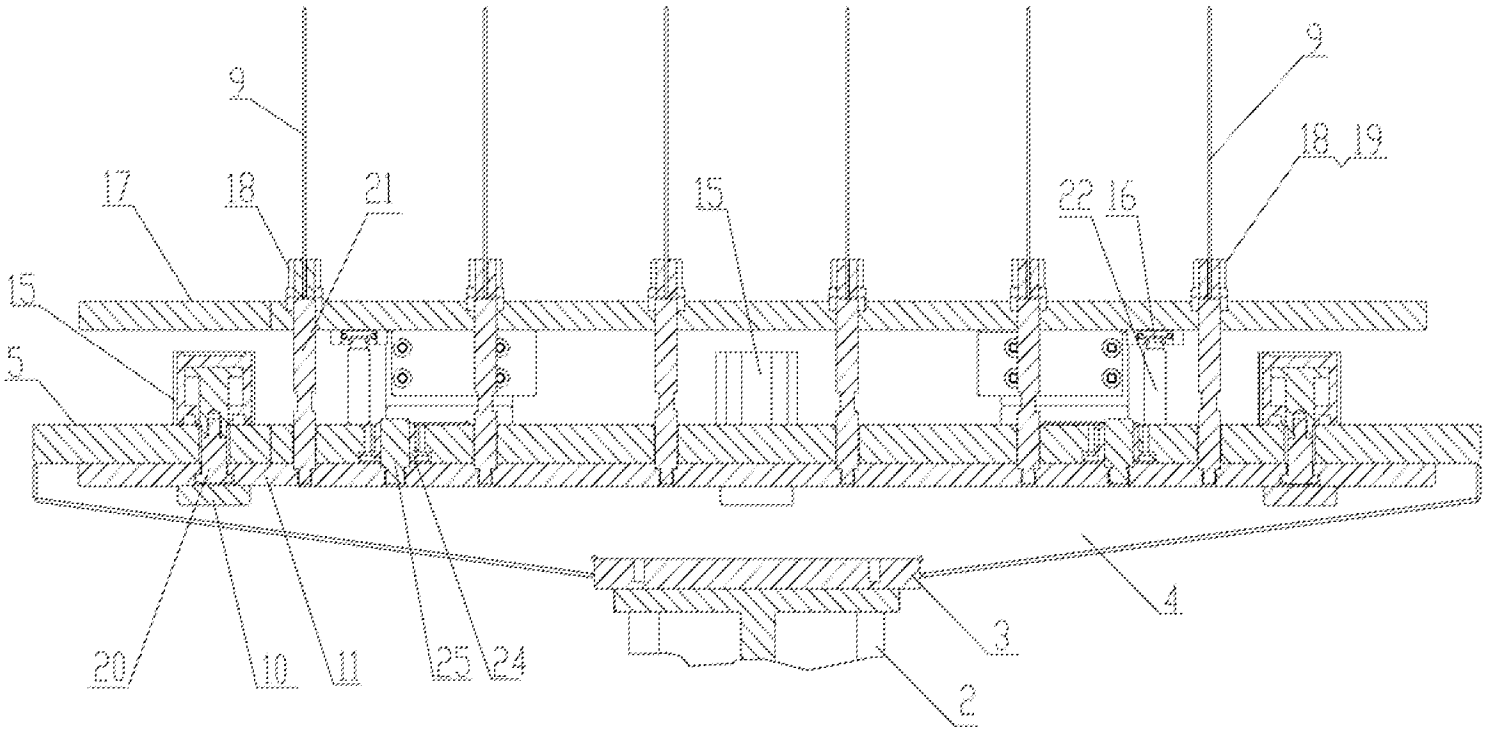
FIG. 8 is a schematic structural partial cross-sectional view of the length positioning and extension device according to the present invention.

As shown in FIGS. 7 and 8, a heating rod 26 is inserted in two vertical bare holes provided in the heating block mounting seat 23 inserted in the bakelite base 7 of the automatic clamping device B; the floating bottom plate 11 connected to the extension cylinder 15 of the length positioning and extension device C is provided with two sets of guide shafts 25, which are slidably connected to the reference bottom plate 5 via an oil-free bushing 24 mounted on the reference bottom plate 5 and guide downward movement of the cylinder floating joint 20.

In the actual production and operation according to the present invention, the position of the length adjustment sliding table in the vertical direction needs to be adjusted in the light of the length of the thin-walled heat pipe 9 to be processed, and the thin-walled heat pipe 9 needs to be sent from the loading area to the opening-sealing area by the lifting cylinder 2 of the automatic lifting device A. Then a suitable heating block 8 is selected according to the diameter of the thin-walled heat pipe 9, and the thin-walled heat pipe 9 is inserted into the respective automatic clamping devices B after the assembly adjustment is completed. According to the programmed instruction control of PLC, the two clamping cylinders 14, mounted on the clamping cylinder mounting plate 13, of the automatic clamping devices B are actuated, such that the piston rod is extended to drive the clamping push plate 17, provided at the connected and fixed front end with the clamping block 18, to move forward along the linear guide pair 16 on the two linear guide mounting plates 22, and thereby the thin-walled heat pipe 9 is closedly clamped by the clamping jacket 19 at the clamping end of the clamping block 18 and the heating block 8 on the respective bakelite bases 7. The automatic lifting device A is actuated such that the piston rod of the lifting cylinder 2 is extended to lift the thin-walled heat pipe 9 into the opening-sealing area. The length positioning and extension C is actuated such that the piston rod of the extension cylinder 15 is extended downward to make the upper flat surface of the fixed-length shaft 21 leave the bottom of the thin-walled heat pipe 9, so that the bottom of the heat pipe is suspended. The opening-sealing die is actuated such that a punch-cum-blanking die closely extrudes the tapered end of the heat pipe 9 to form a cold-welded sealing area. The mechanism is deactuated, and the thin-walled heat pipe 9 is cut along the upper end of the cold-welded sealing area. After the sealed opening is cut, the automatic lifting device A is reset, the piston rod of the lifting cylinder 2 is retracted, and the thin-walled heat pipe 9 is returned to the loading area. The length positioning and extension C is reset, the piston rod of the extension cylinder 15 drives the piston rod of the fixed-length shaft 21 to retract, and the upper flat surface of the fixed-length shaft 21 contacts the bottom of the heat pipe. The automatic clamping device B is reset, the piston rod of the clamping cylinder 14 is retracted, the heating block 8 is disengaged from the clamping jacket 19 of the clamping block 18, the thin-walled heat pipe 9 is loosened, and the processed thin-walled heat pipe 9 is retrieved, thus completing a work cycle. With the automatic clamping device B as a flexible clamping heat pipe, when the thin-walled heat pipe 9 is loaded, the piston rod of the extension cylinder 15 is in a retracted state, the bottom surface of the heat pipe contacts the upper surface of the fixed-length shaft 21, and thus the fixed-length shaft 21 provides vertical positioning and support for the thin-walled heat pipe 9. Before the thin-walled heat pipe 9 is clamped and subjected to the opening sealing operation, the extension cylinder 15 operates according to the control command of PLC, the piston rod is in an extended state, the fixed-length shaft 21 moves downward, and the upper flat surface of the fixed-length shaft 21 leaves the bottom of the thin-walled heat pipe 9. In the actual opening-sealing operation, the fixed-length shaft 21 in the length positioning-extension C does not contact the bottom of the thin-walled heat pipe 9, and the thin-walled heat pipe 9 can freely extend in the vertical direction, thereby offsetting the effect of the downward component force generated by the extrusion of the heat pipe by the die in the die-opening-sealing process, and avoiding deformation of bending and partial sinking of pipe bodies of the thin-walled heat pipes 9 in the secondary degassing process.

The above-described embodiment is merely an example of the present invention, and not intended to limit the implementation and scope of the present invention; the equivalents and modifications that are made in accordance with the scope of the claims of the present invention should be included in the scope of the patent application of the present invention.

The invention claimed is:

1. An automatic secondary degassing fixed-length mechanism for an ultrathin heat pipe, characterized in that: the mechanism comprises an automatic lifting device A installed on a length adjustment sliding table, an automatic clamping device B, a length positioning and extension device C and a PLC;

the automatic lifting device A is composed of a lifting cylinder base (1), a lifting cylinder (2), a lifting cylinder connecting plate (3), a support plate (4), and a reference bottom plate (5); the lifting cylinder (2) is locked on the lifting cylinder base (1) installed on the length adjustment sliding table, the two support plates (4) are vertically and fixedly mounted on a piston push plate of the lifting cylinder (2) via the lifting cylinder connecting plate (3), and the reference bottom plate (5) is fixedly mounted above the two vertically mounted support plates (4);

the automatic clamping device B is composed of a bakelite base mounting plate (6), a bakelite base (7), a heating block (8), a clamping cylinder fixing plate (12), a clamping cylinder mounting plate (13), a clamping cylinder (14), a linear guide pair (16), a clamping push plate (17), a clamping block (18), a linear guide mounting plate (22), and a heating block mounting seat (23); the plurality of the uniformly arranged bakelite base mounting plates (6), and the two clamping cylinder fixing plates (12) and the two linear guide mounting plates (22) symmetrically disposed are locked on the reference bottom plate (5), and the heating block (8) is inserted into the respective bakelite bases (7) fixed on the bakelite base mounting plates (6) through the heating block mounting seat (23); the two clamping cylinders (14) are connected to the clamping cylinder fixing plate (12) via the vertically mounted clamping cylinder mounting plate (13), and the linear guide pair (16) fixed on the two linear guide mounting plates (22) and consisting of a slider and a guide rail is fixed to the clamping push plate (17) provided in the front end with the clamping block (18);

the length positioning and extension device C is composed of a floating joint bottom plate (10), a floating bottom plate (11), an extension cylinder (15), a cylinder floating joint (20), and a fixed-length shaft (21); the extension cylinder (15) is fixed on the surface of the reference bottom plate (5); the floating bottom plate (11) on the floating joint bottom plate (10) is connected by the cylinder floating joint (20); and the floating bottom plate (11) is provided with the fixed-length shaft (21) corresponding to the respective automatic clamping device B.

2. The automatic secondary degassing fixed-length mechanism for the ultrathin heat pipe according to claim 1, characterized in that: a heating rod (26) is inserted in two vertical bare holes provided in the heating block mounting seat (23) inserted in the bakelite base (7) of the automatic clamping device B.

3. The automatic secondary degassing fixed-length mechanism for the ultrathin heat pipe according to claim 1, characterized in that: the mounting hole, via which the reference bottom plate (5) and the bakelite base (7) are fixed to the bakelite base mounting plate (6), is a waist-shaped stepped hole.

4. The automatic secondary degassing fixed-length mechanism for the ultrathin heat pipe according to claim 1, characterized in that: the heating block (8) is provided at its gripping portion with a recess for holding a thin-walled heat pipe.

5. The automatic secondary degassing fixed-length mechanism for the ultrathin heat pipe according to claim 1, characterized in that: the clamping block (18) of the automatic clamping device B is provided at its clamping end with a clamping jacket (19) made of a soft, high temperature resistant material.

6. The automatic secondary degassing fixed-length mechanism for the ultrathin heat pipe according to claim 1, characterized in that: the floating bottom plate (11) connected to the extension cylinder (15) of the length positioning and extension device C is provided with two sets of guide shafts (25), which are slidably connected to the reference bottom plate (5) via an oil-free bushing (24) mounted on the reference bottom plate (5) and guide downward movement of the cylinder floating joint (20).

* * * * *